US009916939B1

(12) United States Patent
Rout et al.

(10) Patent No.: US 9,916,939 B1
(45) Date of Patent: Mar. 13, 2018

(54) ELECTRICAL DISTRIBUTION APPARATUS INCLUDING BARRIER AND METHODS OF ASSEMBLING SAME

(71) Applicant: General Electric Company, Schenectady, NY (US)

(72) Inventors: Tapas Ranjan Rout, Hyderabad (IN); Maxime Pean, West Hartford, CT (US); Heather Ellen Pugliese, Amston, CT (US); Tyler Braden Diomedi, Plainville, CT (US); Leonardo Dorea Mascarenhas, Agawam, MA (US); Suresh M, Hyderabad (IN); Fernando Jorge De Sousa Braga, Moreira (PT); Raquel Gallardo Alvarez, Madrid (ES); Jorge Juan Bonilla Hernandez, Arganda del Rey (ES); Yogesh Ingole, Hyderabad (IN); Mariusz Duda, Berlin, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/402,453

(22) Filed: Jan. 10, 2017

(30) Foreign Application Priority Data

Nov. 11, 2016 (IN) ..... 201641038604

(51) Int. Cl.
*H01H 71/08* (2006.01)
*H01H 73/20* (2006.01)
(Continued)

(52) U.S. Cl.
CPC ..... *H01H 9/0264* (2013.01); *H01H 71/025* (2013.01); *H01H 71/0207* (2013.01);
(Continued)

(58) Field of Classification Search
CPC ..... H01H 1/5844–2001/5877; H01H 71/08; H01H 73/20
See application file for complete search history.

(56) References Cited

U.S. PATENT DOCUMENTS 5,084,689 A * 1/1992 Morgan ..... H01H 9/0072 335/202
5,327,321 A 7/1994 Rosen
(Continued)

FOREIGN PATENT DOCUMENTS

WO 2014209350 A1 12/2014
WO 2015029528 A1 3/2015

*Primary Examiner* — Gary Paumen
(74) *Attorney, Agent, or Firm* — General Electric Company

(57) ABSTRACT

An electrical device includes a case defining an interior space. The case includes a sidewall and a cover. The sidewall defines an opening therethrough to provide access to the interior space. The electrical device also includes a power connector coupled to the case and disposed at least partially within the interior space. The power connector is coupleable to a cable extending through the opening into the interior space of the case. The electrical device further includes a shield removably coupleable to the case. The shield includes an engagement feature and a wall. The engagement feature is arranged to engage the case. The wall is arranged to at least partially cover the opening when the shield is coupled to the case such that the wall and the cable are spaced apart a distance that is less than a width of the opening when the cable is coupled to the power connector.

21 Claims, 10 Drawing Sheets

(51) Int. Cl.

| | |
|---|---|
| ***H01H 9/02*** | (2006.01) |
| ***H01H 73/06*** | (2006.01) |
| ***H01H 71/02*** | (2006.01) |
| ***H01R 13/64*** | (2006.01) |

(52) U.S. Cl.
CPC ..... *H01H 71/08* (2013.01); *H01H 73/06* (2013.01); *H01R 13/64* (2013.01)

(56) References Cited

U.S. PATENT DOCUMENTS 5,486,666 A 1/1996 Wong et al.
5,933,066 A * 8/1999 Chontas ..... H01H 71/08 218/155
5,933,319 A 8/1999 Buckner et al.
6,172,586 B1 * 1/2001 Ferree ..... H01H 71/08 335/202
6,392,514 B1 * 5/2002 Kawata ..... H01H 1/5855 335/132
6,936,781 B2 8/2005 Quintanilla et al.
2003/0070907 A1 * 4/2003 Rochard ..... H01H 1/5866 200/293
2005/0057333 A1 * 3/2005 Subramanian ..... H01H 1/2058 335/202
2005/0109597 A1 5/2005 Etscheidt et al.
2005/0186859 A1 * 8/2005 Lias ..... H01H 11/0031 439/814
2014/0151201 A1 * 6/2014 Sisley ..... H01H 9/0264 200/293
2015/0129400 A1 * 5/2015 Oh ..... H01H 3/22 200/293
2015/0287563 A1 * 10/2015 Fischer ..... H01H 73/20 335/145

* cited by examiner

ELECTRICAL DISTRIBUTION APPARATUS INCLUDING BARRIER AND METHODS OF ASSEMBLING SAME

CROSS REFERENCE TO RELATED APPLICATIONS

This application claims priority to Indian Patent Application No. 201641038604, filed Nov. 11, 2016, which is hereby incorporated by reference in its entirety.

BACKGROUND

The field of the disclosure relates generally to electrical distribution apparatuses, and more particularly, to an electrical distribution apparatus including at least one power connector and a barrier at least partially restricting access to the at least one power connector.

At least some known electrical distribution apparatuses are configured to control electrical distribution from a main to one or more branch circuits. Accordingly, at least some known electrical distribution apparatuses include power connectors such as terminals or lugs for coupling to the circuits. For example, in some electrical distribution apparatuses, a load terminal is positioned on an end of the electrical distribution apparatus and a line terminal is positioned on an opposite end of the electrical distribution apparatuses. In addition, electrical devices, such as circuit breakers, are coupled to the electrical distribution apparatus along an electrically conductive path between the load terminal and the line terminal. The electrical devices also include power connectors. Current flows through the electrical distribution apparatus from the line terminal to the load terminal. When the electrical distribution apparatus has a reverse feed, the current flows through the electrical distribution apparatus from the load terminal to the line terminal.

In at least some known electrical distribution apparatus, it is desirable to restrict access to electrically charged components of the electrical distribution apparatus, such as the power connectors. For example, at least some regulations require that the accessibility of electrically charged components of electrical distribution apparatuses is limited during operation of the electrical distribution apparatuses. As a result, the cost to manufacture and assemble the electrical distribution apparatuses is increased.

BRIEF DESCRIPTION

In one aspect, an electrical device is provided. The electrical device includes a case defining an interior space. The case includes a sidewall and a cover. The sidewall defines an opening therethrough to provide access to the interior space. The electrical device also includes a power connector coupled to the case and disposed at least partially within the interior space. The power connector is coupleable to a cable extending through the opening into the interior space of the case. The electrical device further includes a shield removably coupleable to the case. The shield includes an engagement feature and a wall. The engagement feature is arranged to engage the case. The wall is arranged to at least partially cover the opening when the shield is coupled to the case such that the wall and the cable are spaced apart a distance that is less than a width of the opening when the cable is coupled to the power connector.

In another aspect, a shield for an electrical device is provided. The electrical device includes a power connector and a case, the case including a sidewall that defines an opening that receives a cable. The shield includes an engagement feature to engage said case and removably couple said shield to the case, and a wall arranged to at least partially cover the opening when said shield is coupled to the case such that said wall and the cable are spaced apart a distance that is less than a width of the opening when the cable is coupled to the power connector.

In yet another aspect, a method of assembling an electrical device is provided. The method includes coupling a power connector to a case such that the power connector is disposed at least partially with an interior space defined by a sidewall and a cover of the case, the power connector coupleable to a cable that extends into the interior space through an opening defined in the sidewall of the case, and coupling a shield to the case, the shield arranged to inhibit an operator contacting the power connector, wherein the shield includes an engagement feature and a wall, wherein the engagement feature engages the case, wherein the wall at least partially covers the opening, and wherein the wall and the cable are spaced apart a distance that is less than a width of the opening when the cable is coupled to the power connector.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Exemplary embodiments of an electrical distribution apparatus and methods of manufacturing an electrical distribution apparatus are described herein. The electrical distribution apparatus include removable barriers that selectively couple to components of the electrical distribution apparatus to restrict access to (i.e., to inhibit an operator from contacting) electrically conductive components of the electrical distribution apparatus. For example, in some embodiments, a shield couples to an electrical device, such as a circuit breaker, to restrict access to power connectors of the electrical device. The shield is removably coupled to the electrical device without the use of tools. In addition, in some embodiments, the shield fits within the footprint of the electrical device and does not occupy gutter space of the electrical distribution apparatus. Also, in some embodiments, the shield is adjustable and/or includes inserts to accommodate different connections of the electrical device. For example, in some embodiments, reducers are positioned in an opening of the shield to restrict access to the power connectors when the electrical device couples to cables having smaller diameters.

Figure 1:
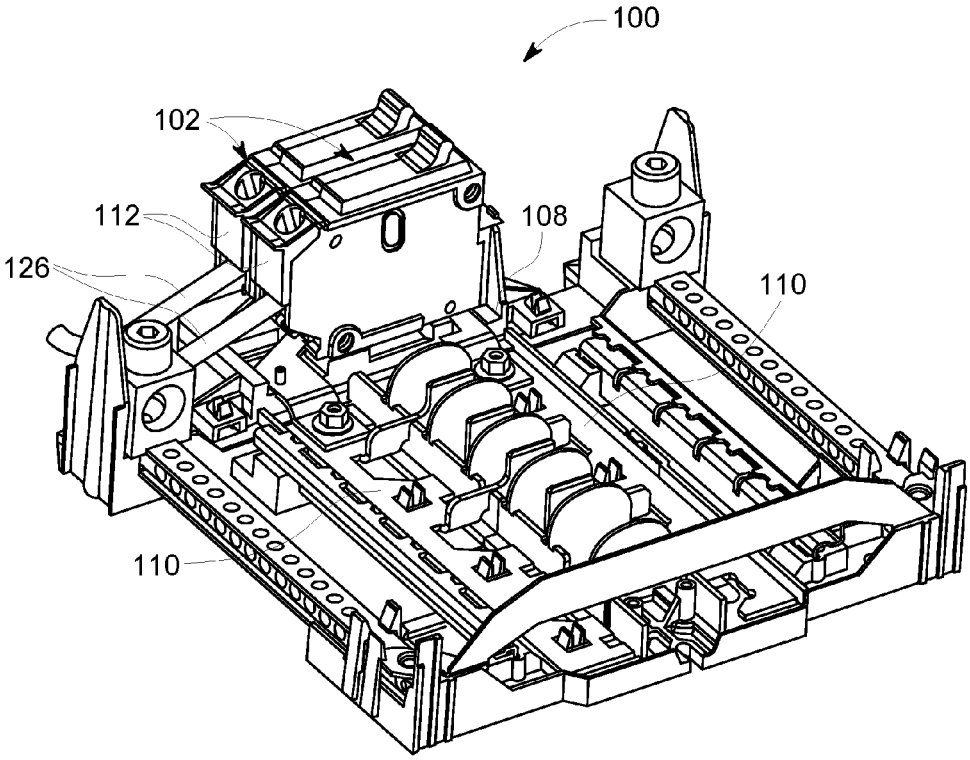
FIG. 1 is a perspective view of an electrical distribution apparatus.

FIG. 1 is a perspective view of an electrical distribution apparatus 100. Electrical distribution apparatus 100 includes electrical devices 102 and a support structure 108 supporting electrical devices 102. During operation, electrical distribution apparatus 100 is coupled to a circuit such that electrical current flows along a conductive flow path coupled to electrical devices 102. Current flows into electrical distribution apparatus 100 from cables or wires 126, through electrical devices 102, and along bus bars 110 coupled to electrical devices 102. Shields 112 are coupled to electrical devices 102 adjacent line ends of electrical devices 102. Accordingly, shields 112 restrict access to (i.e., inhibits an operator from contacting) electrically conductive components of electrical distribution apparatus 100 such as line lugs, broadly power connectors, of electrical devices 102. In alternative embodiments, electrical distribution apparatus 100 includes any component that enables electrical distribution apparatus 100 to operate as described herein.

In the exemplary embodiment, cables 126 include electrically conductive materials surrounded by non-electrically conductive materials. At least a portion of the electrically conductive materials are exposed to couple to electrical distribution apparatus 100. The cables 126 are elongated and flexible to couple to electrical distribution apparatus 100. In alternative embodiments, electrical distribution apparatus 100 couples to any cable 126 that enables electrically distribution apparatus 100 to operate as described herein.

Figure 2:
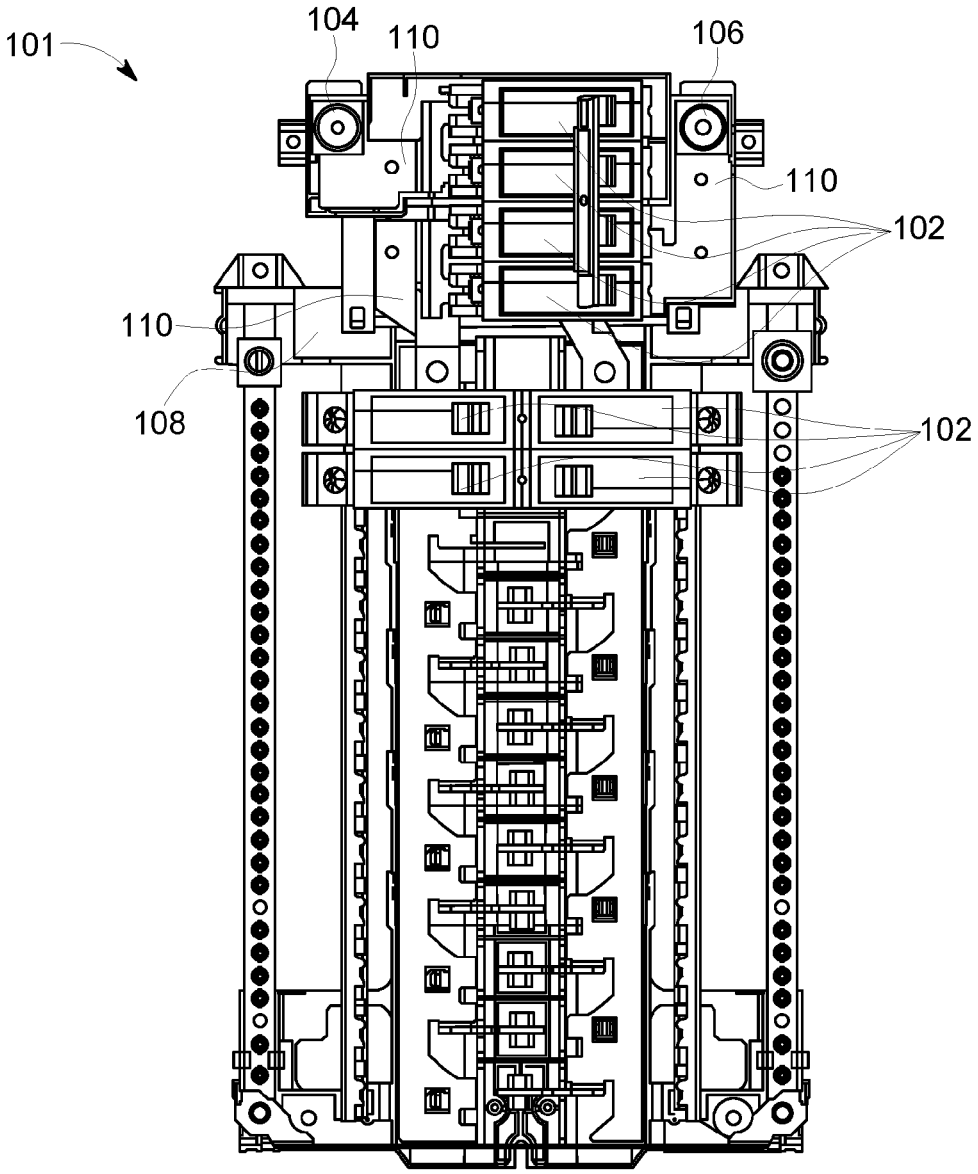
FIG. 2 is a front view of an electrical distribution apparatus including a plurality of electrical devices.

FIG. 2 is a front view of an electrical distribution apparatus 101 including a plurality of electrical devices 102. Electrical distribution apparatus 101 includes a line terminal 104, broadly a first power connector, a load terminal 106, broadly a second power connector, and a support structure 108 supporting line terminal 104 and load terminal 106. During operation, electrical distribution apparatus 101 is coupled to a circuit such that electrical current flows along a conductive flow path from line terminal 104 to load terminal 106. A plurality of electrical devices 102, such as circuit breakers, are coupled to bus bars 110 along the conductive flow path. In alternative embodiments, electrical distribution apparatus 101 includes any component that enables electrical distribution apparatus 101 to operate as described herein.

Figure 3:
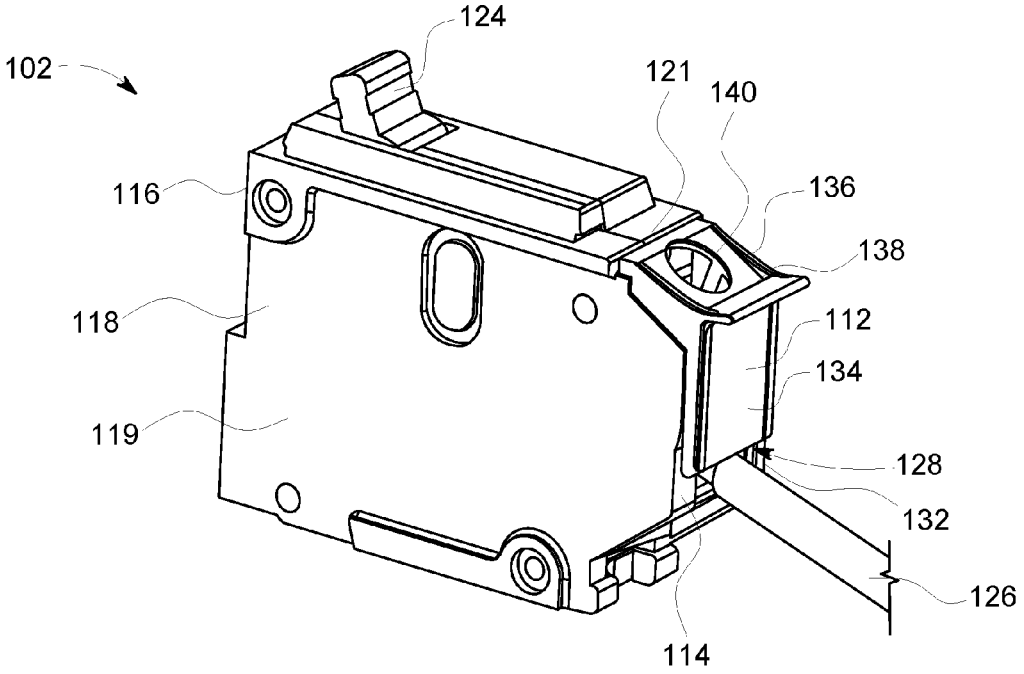
FIG. 3 is a perspective view of an electrical device of the electrical distribution apparatus shown in FIG. 1.
Figure 4:
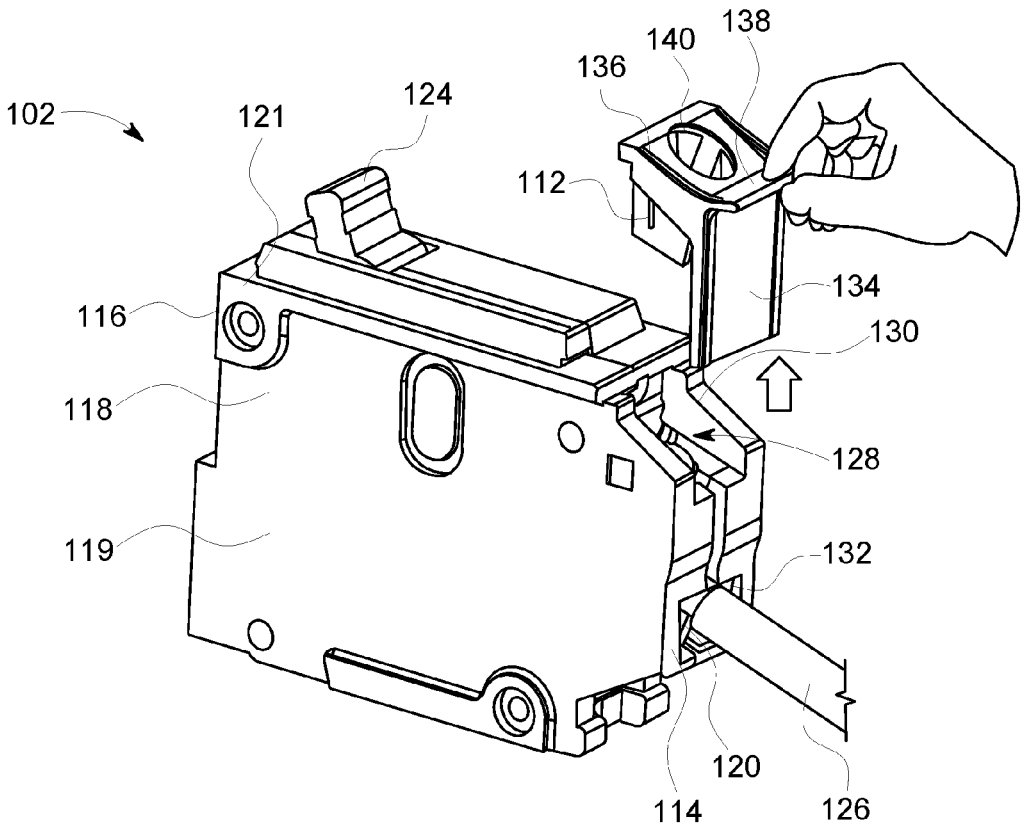
FIG. 4 is a schematic of removal of a shield from the electrical device shown in FIG. 2.

FIG. 3 is a perspective view of an electrical device or circuit breaker 102 for use with electrical distribution apparatus 100 and electrical distribution apparatus 101. FIG. 4 is a schematic of removal of a shield 112 from circuit breaker 102. In the exemplary embodiment, circuit breaker 102 includes shield or barrier 112, a first end 114, a second end 116, a case 118, at least one power connector or lug 120, and an operating mechanism 124. First end 114 is opposite second end 116. First end 114 is configured to receive cables 126 for coupling circuit breaker 102 to a circuit. Second end 116 is configured to couple to bus bars 110 (shown in FIG. 1). In alternative embodiments, circuit breaker 102 includes any component that enables circuit breaker 102 to operate as described herein. For example, in some embodiments, circuit breaker 102 includes load straps, movable contacts, and/or trip mechanisms. In the exemplary embodiment, circuit breaker 102 is coupled to a circuit such that circuit breaker 102 controls flow of electric current through the circuit. In particular, when operating mechanism 124 of circuit breaker 102 is triggered, i.e., circuit breaker 102 is tripped, the flow of electric current through the circuit coupled to circuit breaker 102 is stopped.

In the exemplary embodiment, case 118 defines an interior space 128, a top opening 130, and an end opening 132. Case 118 includes a sidewall 119 and a cover 121. In addition, case 118 defines a footprint of circuit breaker 102, i.e., case 118 substantially defines the outermost bounds of circuit breaker 102. Shield 112 is configured to contact sidewall 119 and extend along sidewall 119 such that shield 112 does not extend substantially beyond the outermost bounds of circuit breaker 102. In the exemplary embodiment, case 118 is a rectangular cuboid. In alternative embodiments, circuit breaker 102 includes any case 118 that enables circuit breaker 102 to operate as described herein.

Also, in the exemplary embodiment, power connector 120 is coupled to case 118 and is disposed within interior space 128. In particular, power connector 120 is positioned adjacent first end 114 of circuit breaker 102. Power connector 120 is coupleable to cable 126. Cable 126 extends through end opening 132 into interior space 128 to couple to power connector 120. In alternative embodiments, circuit breaker 102 includes any power connector 120 that enables circuit breaker 102 to operate as described herein.

In addition, in the exemplary embodiment, shield 112 is removably coupled to first end 114 of case 118 adjacent power connector 120 of circuit breaker 102. Shield 112 extends adjacent power connector 120 to restrict access to power connector 120. In particular, shield 112 inhibits objects, such as a finger, directly contacting power connector 120 when power connector 120 is coupled to cable 126. In alternative embodiments, shield 112 is coupled to any portion of circuit breaker 102.

Figure 5:
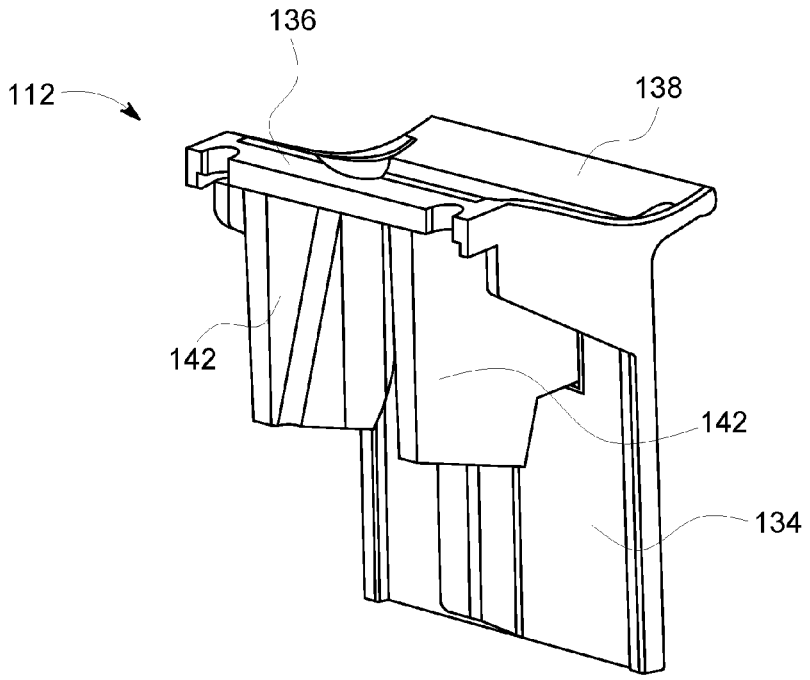
FIG. 5 is a perspective view of the shield shown in FIG. 3.

FIG. 5 is a perspective view of shield 112. Shield 112 includes a wall 134, a leg 136, and a handle 138. Wall 134 is substantially planar. Leg 136 extends away from wall 134 at an angle such that shield 112 is substantially L-shaped. Handle 138 extends from wall 134 opposite leg 136. Wall 134 is arranged to extend adjacent and cover at least a portion of end opening 132 when shield 112 is coupled to case 118. Specifically, wall 134 and cable 126 are spaced apart a distance that is less than a width of opening 132 when shield 112 is coupled to case 118 and line 126 is coupled to lug 120. Leg 136 is arranged to extend at least partially adjacent and cover at least a portion of top opening 130 when shield 112 is coupled to case 118. Accordingly, shield 112 substantially conforms to a profile of case 118. In the exemplary embodiment, wall 134, leg 136, and handle 138 are integrally formed and shield 112 is a single piece. In alternative embodiments, circuit breaker 102 includes any shield 112 that enables circuit breaker 102 to operate as described herein.

In reference to FIG. 4, in the exemplary embodiment, leg 136 defines a top opening 140. Top opening 140 provides access to power connector 120 when shield 112 is coupled to case 118. Accordingly, shield 112 facilitates coupling and decoupling cable 126 and circuit breaker 102 while shield 112 is coupled to case 118. Top opening 140 is sized to inhibit objects larger than a predetermined size from passing through top opening 140. In alternative embodiments, shield 112 includes any opening that enables circuit breaker 102 to operate as described herein.

Also, in the exemplary embodiment, case 118 is arranged to receive at least a portion of shield 112 within interior space 128. In particular, an engagement feature 142 of shield 112 extends within interior space 128 and engages case 118 when shield 112 is coupled to case 118. Engagement feature 142 is at least partially flexible and provides an interference fit with case 118. Accordingly, shield 112 is removably coupled to case 118 without the use of tools. In addition, shield 112 is positioned substantially within the footprint of circuit breaker 102 when shield 112 is coupled to case 118. In alternative embodiments, shield 112 includes any engagement feature that enables shield 112 to function as described herein. For example, in some embodiments, shield 112 includes, without limitation, latches, clips, adhesive, straps, and any other engagement feature.

In addition, in the exemplary embodiment, during operation, shield 112 is coupled to case 118 by inserting shield 112 into interior space 128 until a snap fit is achieved. Also, in the exemplary embodiment, shield 112 includes handle 138 to facilitate positioning shield 112 relative to case 118. During operation, shield 112 is removed from case 118 by applying a force to handle 138. Shield 112 is coupleable to and/or decouple from case 118 before and/or after cable 126 is coupled to circuit breaker 102. In some embodiments, shield 112 is coupleable to cases 118 of installed circuit breakers 102. In alternative embodiments, shield 112 is coupled to case 118 in any manner that enables circuit breaker 102 to operate as described herein.

Figure 6:
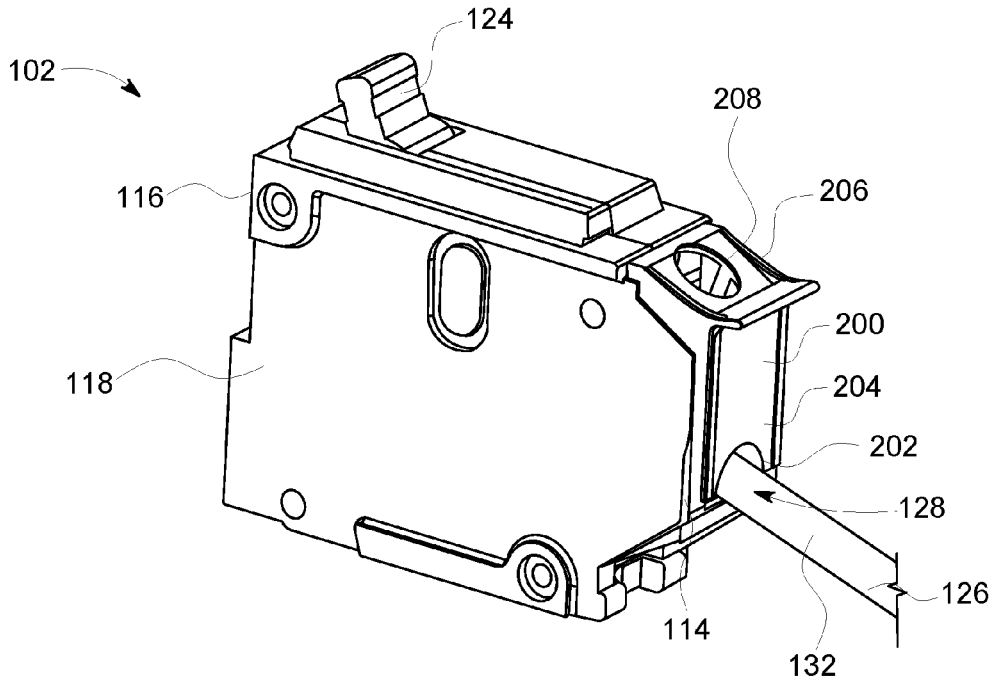
FIG. 6 is a perspective view of the electrical device shown in FIG. 2 including a shield including an opening.

FIG. 6 is a perspective view of circuit breaker 102 including a shield 200 including an end opening 202. Shield 200 includes a wall 204 and a leg 206 extending away from wall 204. Wall 204 defines end opening 202. Wall 204 extends adjacent first end 114 of circuit breaker 102 such that end opening 202 is arranged to receive cable 126 coupled to circuit breaker 102. Wall 204 extends adjacent cable 126 when cable 126 is coupled to circuit breaker 102 to restrict access to (i.e., prevents an operator from contacting) electrically charged components of circuit breaker 102. In the exemplary embodiment, end opening 202 is a semicircle and has a diameter larger than a diameter of cable 126. Accordingly, wall 204 defines an at least partially annular space between shield 200 and cable 126. In alternative embodiments, shield 200 includes any wall that enables shield 200 to function as described herein. For example, in some embodiments, shield 200 is coupled to line ends and load ends of circuit breakers 102.

Also, in the exemplary embodiment, leg 206 defines a top opening 208. Top opening 208 provides access to power connector 120 (shown in FIG. 4) to facilitate coupling and decoupling cable 126 and circuit breaker 102 when shield 200 is coupled to case 118. Top opening 208 is sized to inhibit objects larger than a predetermined size from passing through top opening 208. In alternative embodiments, shield 200 includes any opening that enables circuit breaker 102 to operate as described herein.

Figure 7:
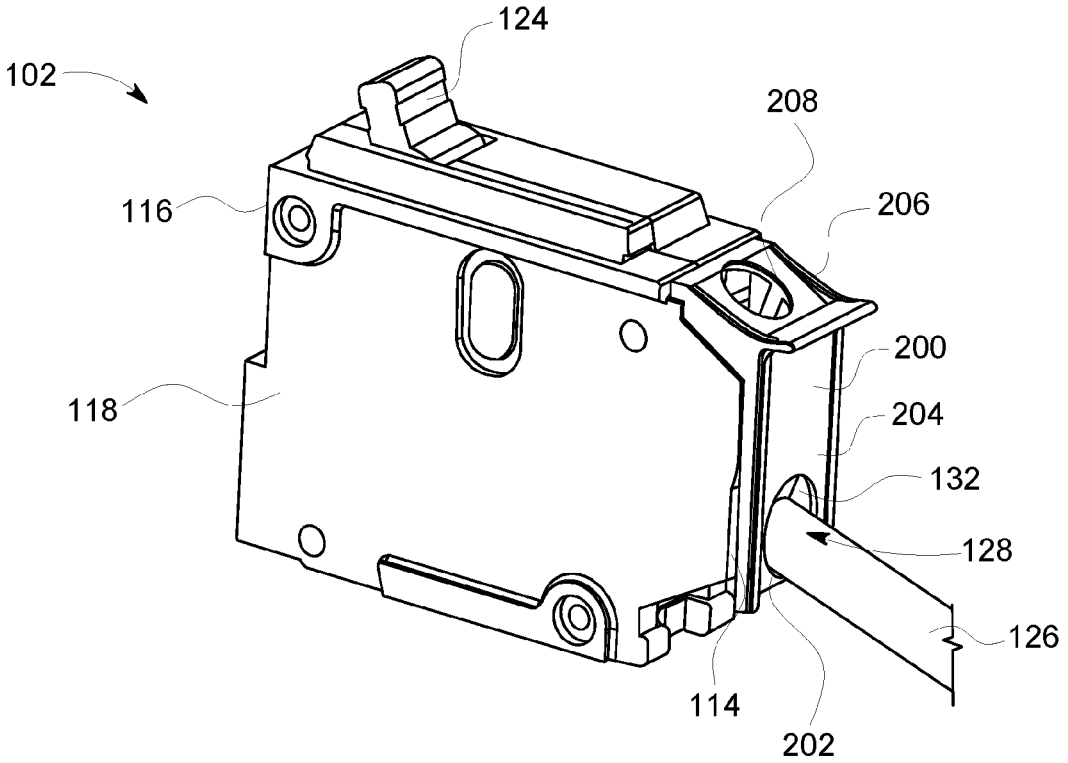
FIG. 7 is a perspective view of the electrical device shown in FIG. 2 including a shield including a wall that surrounds a cable coupled to the electrical device.

FIG. 7 is a perspective view of circuit breaker 102 including a shield 300 including a wall 302 that surrounds cable 126. Shield 300 includes wall 302 and a leg 304 extending away from wall 302. Wall 302 defines an end opening 306. Wall 302 extends adjacent first end 114 of circuit breaker 102 such that end opening 306 is arranged to receive cable 126 coupled to circuit breaker 102. In the exemplary embodiment, end opening 306 is a circle and has a diameter larger than a diameter of cable 126. Accordingly, wall 204 substantially surrounds cable 126 and restricts access to (i.e., prevents an operator from contacting) electrically charged components of circuit breaker 102 when cable is coupled to circuit breaker 102. In alternative embodiments, shield 300 includes any wall that enables shield 300 to function as described herein.

In addition, in the exemplary embodiment, leg 304 defines a top opening 308. Top opening 308 provides access to power connector 120 (shown in FIG. 4) to facilitate coupling and decoupling cable 126 and circuit breaker 102 when shield 300 is coupled to case 118. Top opening 308 is sized to inhibit objects larger than a predetermined size from passing through top opening 308. In alternative embodiments, shield 300 includes any opening that enables circuit breaker 102 to operate as described herein.

Figure 8:
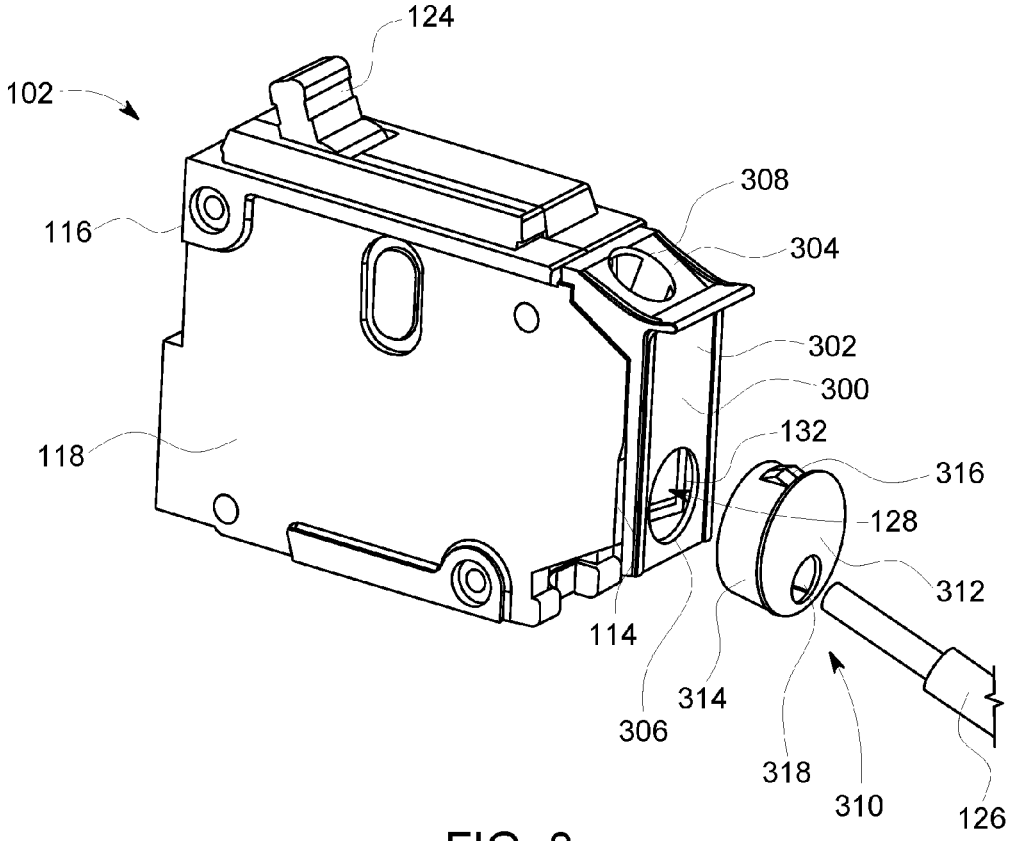
FIG. 8 is a partially exploded perspective view of the electrical device shown in FIG. 6 including an insert.

FIG. 8 is a partially exploded perspective view of circuit breaker 102 and shield 300 including an insert 310. Insert 310 is selectively positioned in end opening 306 and is arranged to restrict access to electrically conductive components of circuit breaker 102. In the exemplary embodiment, insert 310 is a reducer that restricts access when circuit breaker 102 couples to smaller cables 126. Insert 310 includes a planar wall 312. A sidewall 314 extends from planar wall 312. Sidewall 314 includes an engagement feature 316 that facilitates insert 310 coupling to shield 300 without the use of tools. In alternative embodiments, insert 310 includes any engagement feature 316 that enables insert 310 to function as described herein.

In the exemplary embodiment, planar wall 312 defines a reducer opening 318. Reducer opening 318 has a diameter that is less than the diameter of end opening 306. Accordingly, insert 310 is arranged to inhibit objects, such as a finger, extending between insert 310 and cable 126 when cable 126 is coupled to circuit breaker 102. In alternative embodiments, circuit breaker 102 includes any insert that enables circuit breaker 102 to operate as described herein. For example, in some embodiments, circuit breaker 102 includes a plug. In further embodiments, circuit breaker 102 includes a plurality of reducers having different openings.

Figure 9:
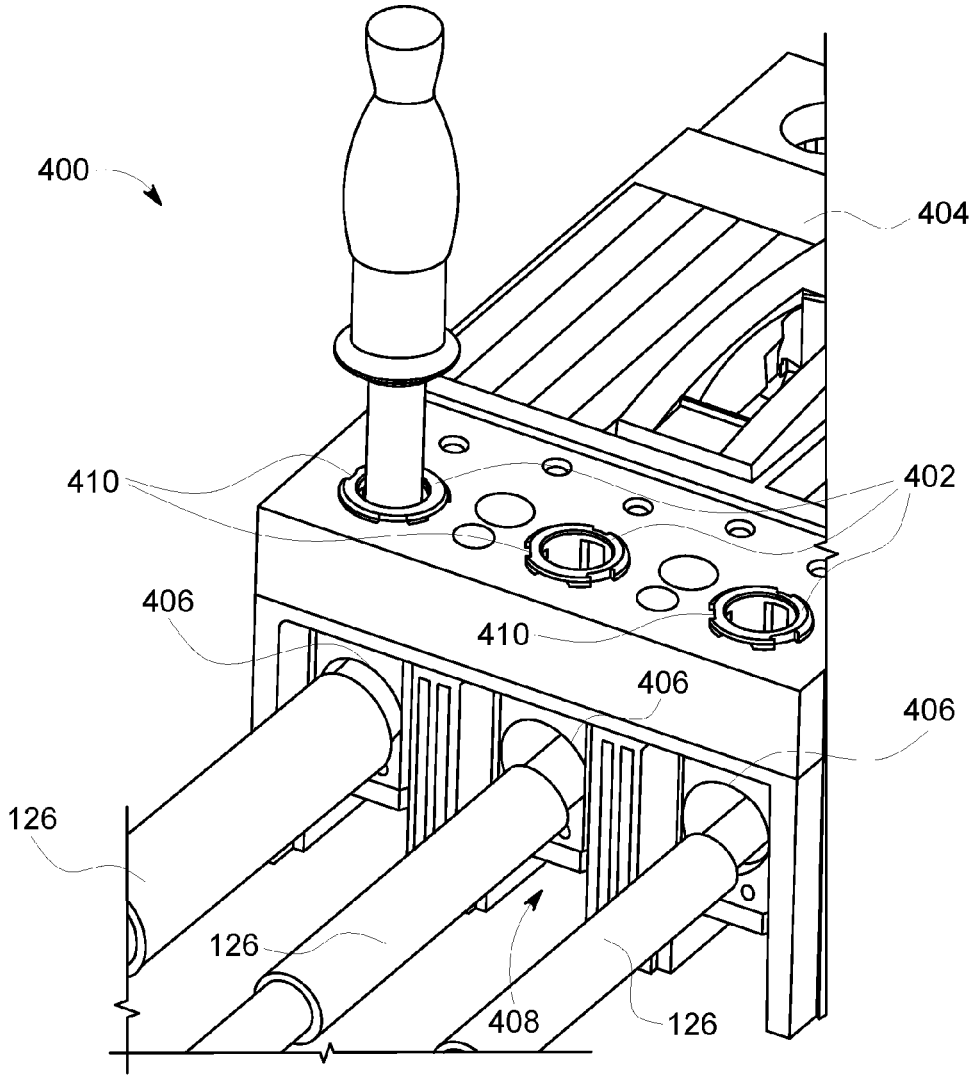
FIG. 9 is a schematic perspective view of a portion of an alternative embodiment of an electrical device.
Figure 10:
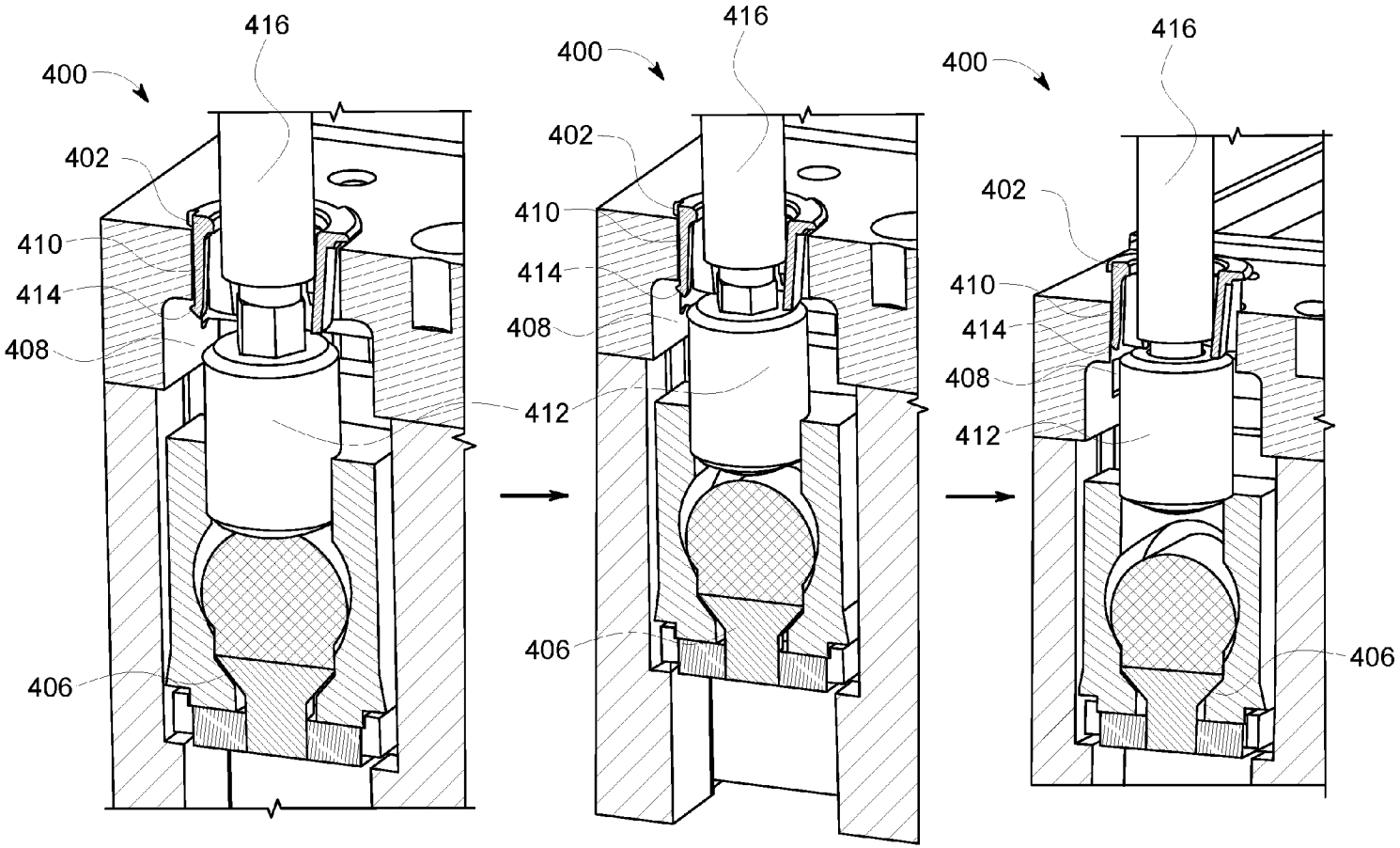
FIG. 10 is a cross-sectional schematic of a cable coupling to the electrical device shown in FIG. 9.
Figure 11:
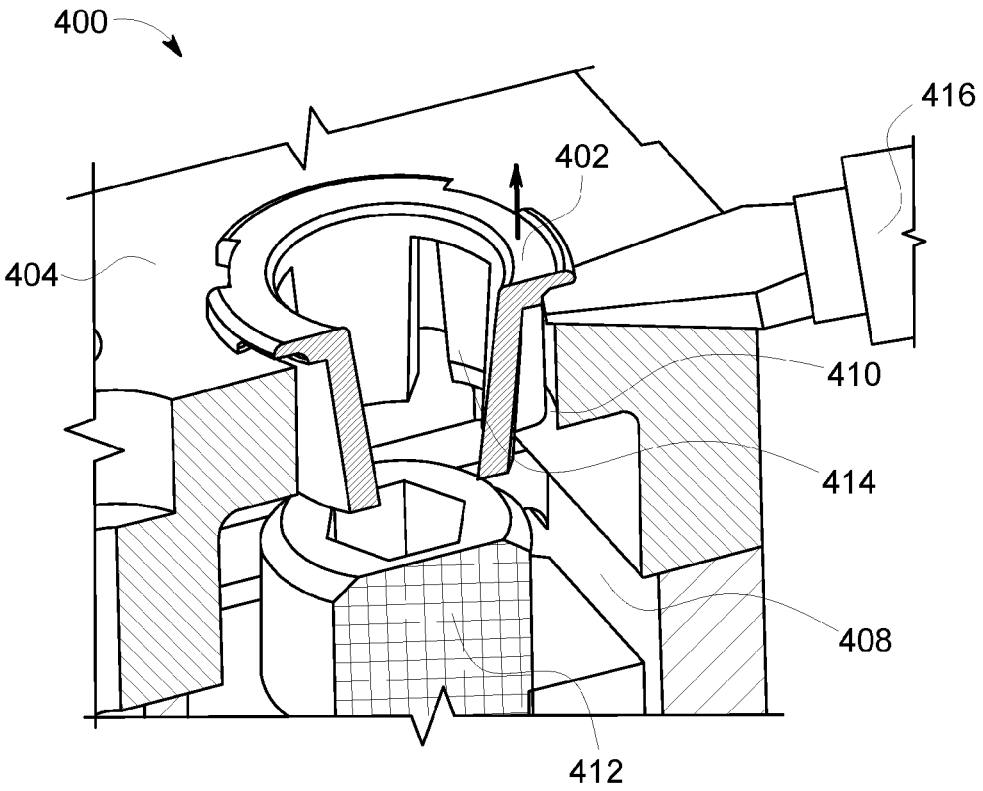
FIG. 11 is a cross-sectional schematic of removal of a shield from the electrical device shown in FIG. 9.

FIG. 9 is a schematic perspective view of a portion of a circuit breaker 400. FIG. 10 is a cross-sectional schematic of cable 126 coupling to circuit breaker 400. FIG. 11 is a cross-sectional schematic of removal of a shield 402 from circuit breaker 400. Circuit breaker 400 includes a case 404 and a plurality of power connectors 406 housed at least partially within an interior space 408 of case 404. Case 404 defines openings 410 that receive shields 402. Each shield 402 restricts access to a respective power connector 406. In particular, in the exemplary embodiment, shield 402 is annular and has an inner diameter that is less than a diameter of openings 410. Accordingly, shield 402 inhibits objects, such as fingers, from accessing interior space 408 and power connectors 406. In alternative embodiments, circuit breaker 400 includes any shield 402 that enables circuit breaker 400 to operate as described herein.

In the exemplary embodiment, each power connector 406 includes a coupler 412 configured to secure cable 126 to power connector 406. For example, in the exemplary embodiment, coupler 412 includes a fastener that is selectively positionable (e.g., using tool 416) to secure a portion of cable 126 to power connector 406. In particular, coupler 412 is engaged with a threaded opening and is positioned by rotating coupler 412. To couple cable 126 and power connector 406, coupler 412 is moved towards cable 126 until coupler 412 compresses cable 126 to restrict movement of cable 126. To uncouple cable 126 and power connector 406, coupler 412 is moved away from cable 126 until cable 126 is released from power connector 406. Shield 402 is arranged to permit tool 416 to access and engage couplers 412 to facilitate coupling and decoupling cables 126 and power connector 406. In alternative embodiments, power connector 406 includes any coupler 412 that enables circuit breaker 400 to operate as described herein.

In addition, in the exemplary embodiment, shield 402 includes at least one engagement feature 414 to engage case 404. Accordingly, shield 402 removably couples to case 404 without the use of tools. During operation, shield 402 is coupled to case 404 by inserting shield 402 into opening 410 until a snap fit is achieved. As shown in FIG. 10, coupler 412 contacts and displaces shield 402 when power connector 406 is decoupled from cable 126. In addition, as shown in FIG. 11, shield 402 is removed from case 404 by inserting tool 416 between shield 402 and case 404 and applying a force to tool 416. In alternative embodiments, shield 402 is coupled to case 404 in any manner that enables circuit breaker 400 to operate as described herein.

In reference to FIGS. 2-4, a method of assembling circuit breaker 102 includes coupling power connector 120 to case 118 such that power connector 120 is disposed at least partially with interior space 128 defined by case 118. The method also includes coupling shield 112 to case 118 to restrict access to power connector 120. Shield 112 includes engagement feature 142 to engage case 118 and wall 134 arranged to at least partially cover opening 132 when shield 112 is coupled to case 118. In some embodiments, the method includes coupling cable 126 to circuit breaker 102 when shield 112 is coupled to case 118. In further embodiments, in reference to the orientation shown in FIG. 3, the method includes positioning shield 112 relative to case 118 such that leg 136 extends adjacent a top of case 118 and wall 134 is arranged to extend adjacent an end of case 118.

The electrical distribution apparatuses described above generally include removable barriers that selectively couple to components of the electrical distribution apparatus to restrict access to electrically conductive components of the electrical distribution apparatus. For example, in some embodiments, a shield couples to an electrical device, such as a circuit breaker, to restrict access to power connectors of the electrical device. The shield is removably coupled to the electrical device without the use of tools. In addition, in some embodiments, the shield fits within the footprint of the electrical device and does not occupy gutter space of the electrical distribution apparatus. Also, in some embodiments, the shield is adjustable and/or includes inserts to accommodate different connections of the electrical device. For example, in some embodiments, reducers are positioned in an opening of the shield to restrict access to the power connectors when the electrical device couples to cables having smaller diameters.

An exemplary technical effect of the methods, systems, and apparatus described herein includes at least one of: (a) reducing cost to assemble electrical distribution apparatus; (b) providing shields that restrict the access to power connectors of electrical devices; (c) providing electrical distribution apparatus that are installed in the field without the use of tools; (d) providing electrical devices that are adjustable to accommodate cables of different sizes; and (e) reducing the size of circuit breakers.

Exemplary embodiments of electrical distribution apparatus and methods of manufacturing electrical distribution apparatus are described above in detail. The electrical distribution apparatus and methods are not limited to the specific embodiments described herein but, rather, components of the electrical distribution apparatus and/or operations of the methods may be utilized independently and separately from other components and/or operations described herein. Further, the described components and/or operations may also be defined in, or used in combination with, other systems, methods, and/or devices, and are not limited to practice with only the electrical distribution apparatus and systems described herein.

The order of execution or performance of the operations in the embodiments of the disclosure illustrated and described herein is not essential, unless otherwise specified. That is, the operations may be performed in any order, unless otherwise specified, and embodiments of the disclosure may include additional or fewer operations than those disclosed herein. For example, it is contemplated that executing or performing a particular operation before, contemporaneously with, or after another operation is within the scope of aspects of the disclosure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electrical device comprising:

a case defining an interior space, said case comprising a sidewall and a cover, said sidewall defining an opening therethrough to provide access to the interior space;

a power connector coupled to said case and disposed at least partially within the interior space, said power connector coupleable to a cable extending through the opening into the interior space of said case; and a shield removably coupleable to said case, said shield comprising an engagement feature and a wall, said engagement feature arranged to engage said case, said wall arranged to at least partially cover the opening when said shield is coupled to said case such that said wall and the cable are spaced apart a distance that is less than a width of the opening when the cable is coupled to said power connector.

2. The electrical device in accordance with claim 1, wherein said shield contacts said sidewall and extends along said sidewall when said shield is coupled to said case.

3. The electrical device in accordance with claim 1, wherein said shield is a single piece.

4. The electrical device in accordance with claim 1, wherein said shield is coupleable to said case without the use of tools.

5. The electrical device in accordance with claim 1 further comprising a coupler arranged to secure the cable to said power connector.

6. The electrical device in accordance with claim 5, wherein said shield permits a tool to engage said coupler when said shield is coupled to said case.

7. The electrical device in accordance with claim 1, wherein said wall at least partially defines an end opening for receiving the cable, said shield arranged to inhibit an operator contacting the power connector through the end opening.

8. The electrical device in accordance with claim 7 further comprising a reducer removably coupled to said shield, said reducer positioned within the end opening.

9. The electrical device in accordance with claim 1, wherein said engagement feature extends at least partially within the interior space.

10. The electrical device in accordance with claim 1, wherein said shield comprises a leg extending away from said wall.

11. The electrical device in accordance with claim 1, wherein said shield comprises a handle to facilitate removal of said shield from said case.

12. The electrical device in accordance with claim 1, wherein said shield is coupleable to at least one of a line end and a load end of said case.

13. A shield for an electrical device, the electrical device including a power connector and a case, the case including a sidewall that defines an opening that receives a cable, said shield comprising:

an engagement feature to engage the case and removably couple said shield to the case; and a wall arranged to at least partially cover the opening when said shield is coupled to the case such that said wall and the cable are spaced apart a distance that is less than a width of the opening.

14. The shield in accordance with claim 13, wherein said shield is a single piece.

15. The shield in accordance with claim 13, wherein said shield is coupleable to the case without the use of tools.

16. The shield in accordance with claim 13, wherein said wall at least partially defines an end opening for receiving the cable, said shield arranged to inhibit an operator contacting the power connector through the end opening when the shield is coupled to the case.

17. The shield in accordance with claim 13 further comprising a leg extending away from said wall, said wall and said leg substantially conforming to a profile of the case.

18. The shield in accordance with claim 13 further comprising a handle to facilitate removal of said shield from the case.

19. A method of assembling an electrical device, the method comprising:

coupling a power connector to a case such that the power connector is disposed at least partially with an interior space defined by a sidewall and a cover of the case, the power connector coupleable to a cable that extends into the interior space through an opening defined in the sidewall of the case; and coupling a shield to the case, the shield arranged to inhibit an operator contacting the power connector, wherein the shield includes an engagement feature and a wall, wherein the engagement feature engages the case, wherein the wall at least partially covers the opening, and wherein the wall and the cable are spaced apart a distance that is less than a width of the opening when the cable is coupled to the power connector.

20. The method in accordance with claim 19 further comprising coupling the cable to the power connector while the shield is coupled to the case.

21. The method in accordance with claim 19 wherein coupling a shield comprises coupling a shield including a leg that extends away from the wall, the leg extending adjacent a top of the case and the wall extending adjacent an end of the case.

* * * * *